United States Patent [19]

Röck et al.

[11] Patent Number: 4,875,746

[45] Date of Patent: Oct. 24, 1989

[54] DRAWER ASSEMBLY

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 154,215

[22] Filed: Feb. 10, 1988

[30] Foreign Application Priority Data

Mar. 5, 1987 [AT] Austria ..... 495/87

[51] Int. Cl.[4] ..... A47B 88/00

[52] U.S. Cl. ..... 312/330.1; 312/263; 312/296

[58] Field of Search ..... 312/330 R, 296, 263, 312/257.5 M, 257 R, 229

[56] References Cited

U.S. PATENT DOCUMENTS

| | | | |
|---|---|---|---|
| 1,905,857 | 4/1933 | Hamilton | 312/330 R |
| 1,936,733 | 11/1933 | Richardson | 312/330 R |
| 2,118,525 | 5/1938 | Richardson | 312/330 R X |
| 4,304,449 | 12/1981 | Litchfield et al. | 384/19 X |
| 4,549,774 | 10/1985 | Bessinger et al. | 384/19 |
| 4,601,523 | 7/1986 | Wenzlick et al. | 312/330 R |
| 4,615,572 | 10/1986 | Nelson | 384/19 X |
| 4,645,359 | 2/1987 | Nelson | 384/19 |
| 4,671,581 | 6/1987 | Faust et al. | 312/330 R |

FOREIGN PATENT DOCUMENTS

| | | | |
|---|---|---|---|
| 124059 | 11/1984 | European Pat. Off. | 312/330 R |
| 3316542 | 11/1984 | Fed. Rep. of Germany | 312/330 SM |
| 270021 | 11/1950 | Switzerland | 312/330 R |
| 1341399 | 12/1973 | United Kingdom | 312/330 R |

*Primary Examiner*—Peter A. Aschenbrenner
*Assistant Examiner*—Thomas A. Rendos
*Attorney, Agent, or Firm*—Wenderoth, Lind & Ponack

[57] ABSTRACT

A drawer includes a bottom plate engaged with two metal drawer side walls each having a Z-shaped profile including upper and lower horizontal flanges. The bottom plate is positioned on the lower horizontal flanges of the drawer side walls. On each side of the drawer, a sealing member of plastics material is arranged between the bottom plate and the respective drawer side wall. Each sealing member has a covering lip for covering the gap between the bottom plate and the drawer side wall.

5 Claims, 2 Drawing Sheets

Fig. 3
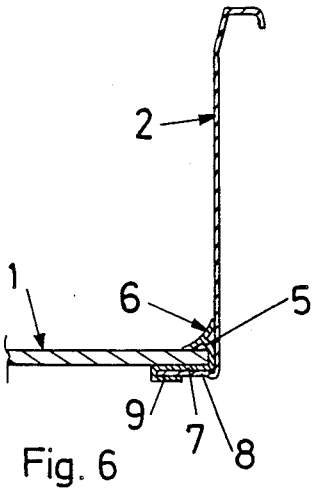
Fig. 6
Fig. 4
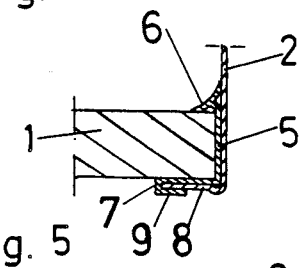
Fig. 5
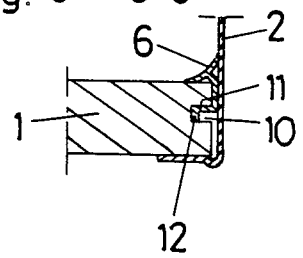
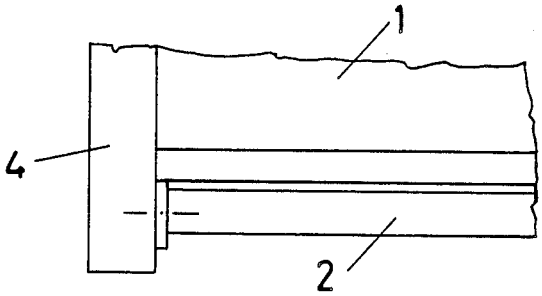
Fig. 7
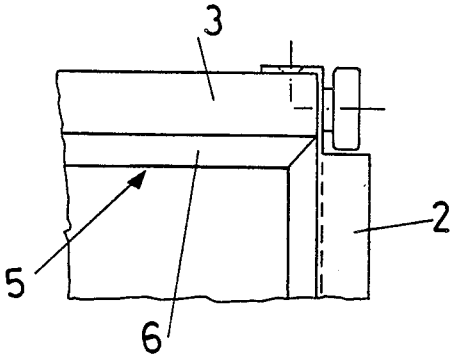

DRAWER ASSEMBLY

FIELD AND BACKGROUND OF THE INVENTION

The invention relates to a drawer having a bottom plate with engaged two metal drawer side walls each having a Z-shaped profile with upper and lower horizontal flanges, the bottom plate being positioned on the lower horizontal flanges of the two drawer side walls, and on each side of the drawer, inside thereof, a separate sealing member of plastics material or the like being arranged between the bottom plate and the respective drawer side wall and covering the gap between the bottom plate and the drawer side wall inside.

Generally, pull-out rails of pull-out guide assemblies which facilitate extraction and insertion of a drawer are fastened to the side walls of the drawer.

Lately, drawers of the above-mentioned type in which the metal drawer side walls have the function of pull-out rails have come into use.

In comparison with drawers having side walls of injection-moulded or extruded plastics material, drawers of the above-mentioned kind often have the disadvantage that there is a small gap between the bottom plate and each drawer side wall, in which gaps dust accumulates.

According to EP-A2-124 059, it is suggested to fasten a sealing member covering such gap to each drawer side wall.

SUMMARY OF THE INVENTION

According to the invention, each sealing member has a horizontal flange which either lies between the bottom plate and the lower horizontal flange of the drawer side wall and has at its free end a pocket or recess into which is inserted the lower horizontal flange, the sealing member having a U-shaped portion embracing the bottom plate, or which extends into a lateral groove of the bottom plate.

If the material from which the sealing member is made is sufficiently rigid, the sealing member also serves as a clamping and holding member which holds the bottom plate at the drawer side wall. The horizontal flange of the sealing member and the sealing lip then receive the bottom plate therebetween in a clamping manner.

The bottom plate is preferably a hardboard and may therefore be very thin.

A further feature of the invention provides that the flange of the sealing member has an end or marginal web which covers the bottom of the groove in the bottom plate.

The flange and the marginal web in this arrangement may be clamped in the groove because of their elasticity.

In all embodiments, the sealing member is securely held at the bottom plate, and the sealing lip cannot unintentionally be lifted from the bottom plate.

BRIEF DESCRIPTION OF THE DRAWINGS

In the following two embodiments of the invention will be described in more detail with reference to the accompanying drawings, in which:

FIG. 3 is a vertical sectional view of a drawer side wall with a bottom plate according to the invention, FIGS. 4 and 5, are vertical sectional views illustrating alternative connections between a drawer side wall and the bottom plate, FIG. 6 is a top view of the front corner of the drawer, and FIG. 7 is a top view of the rear corner of the drawer.

DESCRIPTION OF THE PREFERRED EMBODIMENTS

Figure 1:
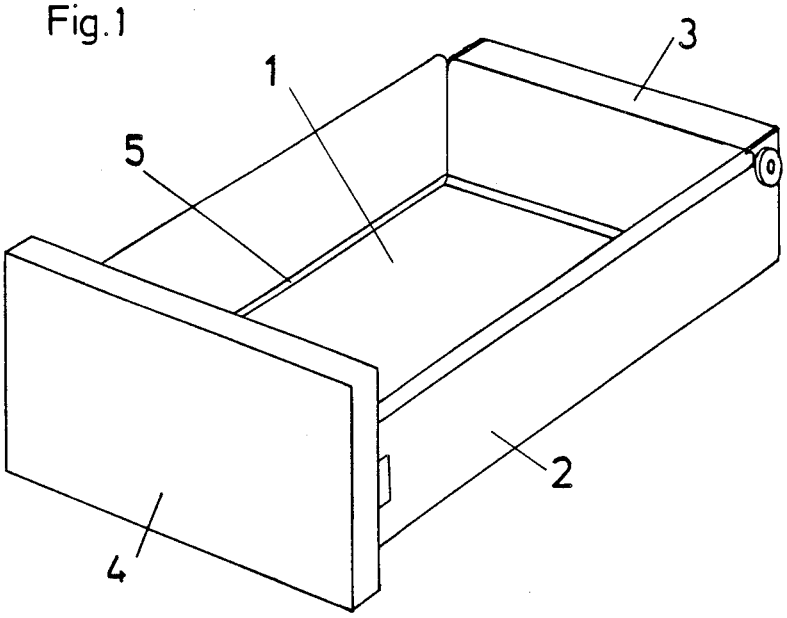
FIG. 1 is a perspective view of a drawer according to the invention.
Figure 2:
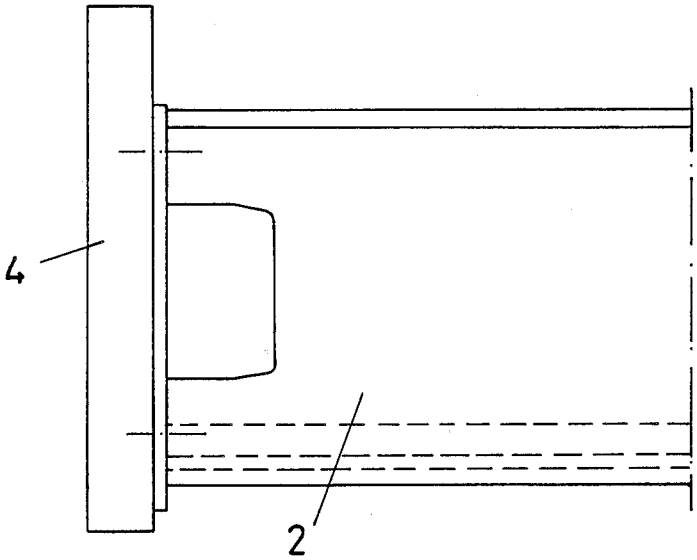
FIG. 2 is a side view of the front end of a drawer side wall.

The drawer according to the invention comprises, in a manner known per se, a bottom plate 1, side walls 2, a rear wall 3 and a front plate 4.

The manner of fastening the front plate 4 and the rear wall 3 of the drawer to the two drawer side walls 2 will not be described in detail in this specification since this is not directly related to the invention.

As can particularly be seen in FIGS. 3 to 5, a sealing member 5 is arranged between the bottom plate 1 and each drawer side wall 2. The sealing member 5 includes a covering lip 6 which covers the gap between the bottom plate 1 and the drawer side wall 2. In this arrangement, the covering lip 6 advantageously resiliently abuts on the drawer side wall 2 and the bottom plate 1 so that a secure seal between such two parts and the covering lip 6 is obtained.

In the embodiment according to FIGS. 3 and 4, the sealing member 5 is provided with a flange 7 positioned between the bottom plate 1 and a lower horizontal flange 8 of the drawer side wall 2. At the free edge thereof flange 7 is reversely bent or extended to form a pocket or angular portion 9 into which is inserted the horizontal flange 8 of the drawer side wall 2.

Thus, the sealing member 5 is securely held at the drawer side wall 2 and, furthermore, the bottom plate 1 is securely well connected thereto.

If the material of the sealing member 5 is sufficiently rigid, no further means for fastening the bottom plate 1 to the drawer side wall 2 will be necessary in many cases.

In the embodiment according to FIG. 5, the bottom plate 1 is provided with a groove 10. A horizontal flange 11 of the sealing member 5 projects into groove 10. Flange 11 is provided with a vertical end or marginal flange 12 which covers the bottom of the groove 10. In this embodiment, the sealing member 5 is entirely supported by the bottom plate 1.

As can be seen from FIGS. 6 and 7, the sealing member 5 completely covers the gap between the bottom plate 1 and the drawer side wall by means of the covering lip 6. The sealing member 5 according to the invention may also be arranged between the rear wall 3 of the piece of furniture or between the front plate 4 and the bottom plate 1 without having a holding function in this position.

What is claimed is:

1. In a drawer assembly including a bottom plate and metal side walls on each of opposite sides of said bottom plate, each said side wall having a Z-shaped profile including upper and lower horizontal flanges, said bottom plate being positioned on said lower horizontal flanges of said side walls, and sealing members separate from said side walls, each said sealing member covering a gap between said bottom plate and a respective said side wall, the improvement wherein each said sealing member comprises:

a U-shaped configuration embracing the respective side of said bottom plate and positioned between said bottom plate and the respective said side wall, said U-shaped configuration including a horizontal flange positioned between said bottom plate and said lower horizontal flange of said respective side wall, said horizontal flange of said sealing member having a free end defining a recess into which is fitted said lower horizontal flange of said respective side wall.

2. The improvement claimed in claim 1, wherein said U-shaped configuration further includes a vertical flange integral with and extending upwardly from said horizontal flange, said vertical flange being positioned between said bottom plate and said respective side wall, and a lip portion integral with said vertical flange, said lip portion covering the respective said gap and abutting said respective side wall and the top of said bottom plate.

3. The improvement claimed in claim 1, wherein said sealing members are formed of plastic material.

4. The improvement claimed in claim 1, wherein said bottom plate is a hardboard.

5. The improvement claimed in claim 1, wherein said sealing members embrace said bottom plate in a clamping arrangement.

* * * * *